US005419853A

United States Patent [19]

Kemen

[11] Patent Number: 5,419,853

[45] Date of Patent: May 30, 1995

[54] LIQUID DETERGENTS CONTAINING ANIONIC SURFACTANT, CARBOXYLATE BUILDER, PROTEOLYTIC ENZYME, AND ALKANOLAMINE

[75] Inventor: Kenneth M. Kemen, Cincinnati, Ohio

[73] Assignee: The Procter & Gamble Company, Cincinnati, Ohio

[21] Appl. No.: 224,117

[22] Filed: Apr. 6, 1994

Related U.S. Application Data

[63] Continuation of Ser. No. 882,388, May 13, 1992, abandoned.

[51] Int. Cl.[6] ..... C11D 3/386

[52] U.S. Cl. ..... 252/548; 252/546; 252/550; 252/551; 252/552; 252/553; 252/174.12; 252/174.19; 252/DIG. 12; 252/DIG. 19

[58] Field of Search ..... 252/174.12, 174.19, 252/546, 548, 550, 551, 552, 553, DIG. 12, DIG. 14

[56] References Cited

U.S. PATENT DOCUMENTS 4,507,219 3/1985 Hughes ..... 252/118
4,537,706 8/1985 Severson, Jr. ..... 252/545
4,561,998 12/1985 Wertz et al. ..... 252/547
5,030,378 7/1991 Venegas ..... 252/174.12

FOREIGN PATENT DOCUMENTS 87355638 4/1987 Australia .
0130756 9/1985 European Pat. Off. .
0342177 11/1989 European Pat. Off. .
0194956 3/1988 United Kingdom .

*Primary Examiner*—Paul Lieberman
*Assistant Examiner*—Kery Fries
*Attorney, Agent, or Firm*—Jacobus C. Rasser; Jerry J. Yetter; Michael D. Jones

[57] ABSTRACT

Heavy duty liquid detergent compositions containing high levels of anionic synthetic surfactant, carboxylate detergency builder, proteolytic enzyme, and alkanolamine are disclosed. The high level of alkanolamine, preferably monoethanolamine, prevents or minimizes crystallization of the protease during storage of the compositions. The compositions are preferably clear, homogeneous, and stable, and are particularly useful as laundry detergents that provide good cleaning performance on enzyme-sensitive stains.

18 Claims, No Drawings

LIQUID DETERGENTS CONTAINING ANIONIC SURFACTANT, CARBOXYLATE BUILDER, PROTEOLYTIC ENZYME, AND ALKANOLAMINE

This is a continuation of application Ser. No. 07/882,388, filed on May 13, 1992, now abandoned.

TECHNICAL FIELD

The present invention relates to heavy duty liquid detergent compositions, preferably for laundry use, containing anionic synthetic surfactant, carboxylate builder, proteolytic enzyme, alkanolamine, and water. The compositions have high levels of anionic surfactant, carboxylate builder, and proteolytic enzyme, and yet have good phase stability. They preferably are clear, homogeneous, and stable liquids as made and during storage. The compositions also provide good cleaning performance, particularly through-the-wash, on enzyme-sensitive stains.

BACKGROUND OF THE INVENTION

Liquid detergents containing high levels of anionic surfactant and builder, and capable of providing superior cleaning performance, are currently on the market. Some of these compositions contain enzymes to enhance removal of enzyme-sensitive stains. The stabilization of enzymes is particularly difficult in these compositions because anionic surfactants, especially alkyl sulfates, tend to denature enzymes and render them inactive. Detergency builders can also sequester the calcium ion needed for enzyme activity and/or stability.

European Patent Application 130,756, Bott et al., published Jan. 9, 1985, discloses specific proteolytic enzymes and methods for their preparation. The enzymes of this reference are said to be useful in laundry detergents, both liquid and granular. They can be combined with surfactants (including anionics), builders, bleach and/or fluorescent whitening agents.

U.S. Pat. No. 5,030,378, Venegas, issued Jul. 9, 1991, discloses heavy duty liquid laundry detergents containing a protease referred to as "Protease A", anionic surfactant, detergency builder, and calcium ion. The compositions provide good cleaning performance, particularly through-the-wash, of enzyme-sensitive stains.

An improved proteolytic enzyme referred to as "Protease B" is described in European Patent Application Serial Number 87303761.8, filed Apr. 28, 1987, on pages 17, 24 and 98. Protease B differs from the above cited Protease A in that it has a leucine substituted for the tyrosine in position 217 on the protein backbone.

U.S. Pat. No. 4,507,219, Hughes, issued Mar. 26, 1985, discloses heavy duty liquid laundry detergents that can contain proteolytic enzyme along with anionic surfactant, saturated fatty acid, polycarboxylate builder, a neutralization system, and a solvent system. The compositions contain from 0 to about 0.04 moles of alkanolamine per 100 grams of composition. The amount of alkanolamine is minimized for best chlorine bleach compatibility.

Despite the above disclosures, it is difficult to formulate a clear, homogeneous and phase stable liquid detergent containing high levels of anionic surfactant, carboxylate builder, and enzyme. It has been found that the protease in such compositions tends to crystallize during storage, particularly after a few months or at higher temperatures. This is evidenced by the formation of a hazy product that phase separate over time. The hazy material has been determined to be crystalline protease. Thus, there is a continuing need for the development of a clear, homogeneous, and phase stable liquid detergent containing high levels of anionic surfactant, carboxylate builder, and protease.

SUMMARY OF THE INVENTION

The present invention relates to a heavy duty liquid detergent composition comprising, by weight:

(a) from about 20% to about 35% of an anionic synthetic surfactant;
(b) from about 7% to about 15% of a water-soluble carboxylate builder;
(c) from about 1.5% to about 5% of a proteolytic enzyme stock solution;
(d) from about 0.05 to about 0.25 moles per 100 grams of composition of monoethanolamine or triethanolamine, or mixtures thereof; and
(e) from about 35% to about 55% of water.

DESCRIPTION OF THE INVENTION

The compositions herein contain as essential ingredients anionic synthetic surfactant, water-soluble carboxylate builder, proteolytic enzyme, alkanolamine, and water. The compositions have good phase stability. They are preferably clear, homogeneous, and phase stable liquids as made and during storage. The relatively high level of alkanolamine, particularly monoethanolamine, in the compositions has been found to minimize or prevent the protease crystallization problem described above.

Anionic Synthetic Surfactant

The compositions of the present invention contain from about 20% to about 35%, preferably from about 22% to about 30%, more preferably from about 23% to about 28%, by weight of an anionic synthetic surfactant. Suitable synthetic anionic surfactants are disclosed in U.S. Pat. No. 4,285,841, Barrat et al., issued Aug. 25, 1981, and in U.S. Pat. 3,929,678, Laughlin et al., issued Dec. 30, 1975, both incorporated herein by reference.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 14.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy- alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Preferred anionic surfactants are the $C_{10}$–$C_{18}$ (especially $C_{12}$–$C_{15}$) alkyl sulfates and alkyl ethoxy sulfates containing an average of up to about 4 ethylene oxide units per mole of alkyl sulfate, $C_{11}$–$C_{13}$ linear alkylbenzene sulfonates, and mixtures thereof.

The compositions herein preferably also contain from about 1% to about 10%, preferably from about 1.5% to about 5%, of an ethoxylated nonionic surfactant. The weight ratio of synthetic anionic surfactant (on an acid basis) to nonionic surfactant is preferably from about 3:1 to about 20:1, more preferably from about 5:1 to about 15:1. The nonionic surfactant helps ensure the formation and adsorption of sufficient hardness surfactant at the air/water interface to provide good greasy/oily soil removal.

The ethoxylated nonionic surfactant is of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (Hydrophilic-Lipophilic Balance) of from about 6 to about 14, preferably from about 10 to about 13. These surfactants are more fully described in U.S. Pat. Nos. 4,285,841, Barrat et al., issued Aug. 25, 1981, and 4,284,532, Leikhim et al., issued Aug. 18, 1981, both incorporated herein by reference. Particularly preferred are condensation products of $C_{12}$–$C_{15}$ alcohol with from about 3 to about 8 moles of ethylene oxide per mole of alcohol, e.g., $C_{12}$–$C_{13}$ alcohol condensed with about 6.5 moles of ethylene oxide per mole of alcohol.

Other surfactants, useful in the present compositions at levels up to about 10% by weight, preferably up to about 5%, include the cosurfactants in U.S. Pat. No. 4,507,219, Hughes, issued Mar. 26, 1985; the alkylpolysaccharides in U.S. Pat. No. 4,565,647, Llenado, issued Jan. 21, 1986; and the polyhydroxy fatty acid amide surfactants in Irish Patent Application 91-3410, published Mar. 28, 1992, all incorporated herein by reference.

Carboxylate Detergency Builder

The compositions herein contain from about 7% to about 15%, preferably from about 8% to about 13%, more preferably from about 9% to about 12%, by weight, of a water-soluble carboxylate detergency builder. Included are fatty acids containing from about 10 to about 18 carbon atoms and/or polycarboxylate builders know in the art. The compositions preferably contain from 0 to about 10% (more preferably from about 1% to about 5%) by weight of saturated fatty acid containing from about 12 to about 14 carbon atoms, along with from 1 to about 15%, more preferably from about 2% to about 12%, most preferably from about 5% to about 10%, by weight of polycarboxylate builder, preferably comprising citric acid, in a weight ratio of polycarboxylate builder to fatty acid of from 1:1 to 5:1, preferably about 2:1 to about 4:1.

Suitable saturated fatty acids can be obtained from natural sources such as plant or animal esters (e.g., palm kernel oil, palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids; from about 5:1 to 1:1 (preferably about 3:1) weight ratio mixtures of lauric and myristic acid; mixtures of the above with minor amounts (e.g., 1%–30% of total fatty acid) of oleic acid; and palm kernel fatty acid.

The compositions herein preferably also contain water-soluble polycarboxylate builders known in the art. Suitable polycarboxylate builders include the various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate; sodium and potassium nitrilotriacetate; the water-soluble salts of phytic acid, e.g., sodium and potassium phytates, disclosed in U.S. Pat. No. 1,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Other useful detergency builders include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms: (d) the site of attachment of the polymer chain of any carboxyl- containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates are the polyacetal carboxylates described in U.S. Pat. No. 4,144,226, issued Mar. 13, 1979 to Crutchfield et al., and U.S. Pat. No. 4,146,495, issued Mar. 27, 1979 to Crutchfield et al., both incorporated herein by reference.

Other preferred builders are those of the general formula R—CH(COOH)$CH_2$(COOH), i.e. derivatives of succinic acid, wherein R is $C_{10}$–$C_{20}$, preferably $C_{12}$–$C_{16}$, alkyl or alkenyl, or wherein R may be substituted with hydroxyl, sulfo, sulfoxy or sulfone substituents. These succinate builders are preferably used in the form of their water soluble salts, including the sodium, potassium and alkanolammonium salts. Specific examples of succinate builders include: lauryl succinate, myristyl succinate, palmityl succinate, 2-dodecenyl succinate (preferred), and the like.

Certain compositions herein preferably contain from 0 to about 10%, more preferably from 1 to about 5%, by weight on an acid basis, of tartrate succinate builders described in U.S. Pat. No. 4,663,071, Bush et al., issued May 5, 1987, incorporated herein by reference.

The compositions also preferably contain from 1% to about 10%, more preferably from about 3% to about 8%, by weight of citric acid.

Alkanolamine

The present compositions also contain from about 0.05 to about 0.25 moles, preferably from about 0.055 to about 0.2 moles, more preferably from about 0.06 to about 0.1 moles, per 100 grams of composition of monoethanolamine, triethanolamine, or mixtures thereof. This relatively high level of alkanolamine minimizes or prevents protease crystallization in the present compositions. Monoethanolamine is particularly preferred, and also enhances product stability, detergency performance, and odor.

Proteolytic Enzyme

The compositions of the present invention contain from about 1.5% to about 5%, preferably from about 1.75% to about 4%, preferably from about 2% to about 3%, by weight of a proteolytic enzyme stock solution.

The proteolytic enzyme can be of animal, vegetable or microorganism (preferred) origin. More preferred is serine proteolytic enzyme of bacterial origin. Purified or nonpurified forms of this enzyme can be used. Proteolytic enzymes produced by chemically or genetically modified mutants are included. Particularly preferred is bacterial serine proteolytic enzyme obtained from *Bacillus subtilis* and/or *Bacillus licheniformis*.

Suitable proteolytic enzymes include Alcalase®, Esperase®, Savinase®, Maxatase®, Maxacal®, Maxapem 15®, and subtilisin BPN and BPN', which are commercially available. Preferred proteolytic enzymes are also modified bacterial serine proteases, such as those described in European Patent Application Ser. No. 87 303761.8, filed Apr. 28, 1987 (particularly pages 17, 24 and 98), and European Patent Application 0342177, Showell et al, published Nov. 15, 1989, both incorporated herein by reference, particularly "Protease B" therein (which is preferred), and in European Patent Application 199,404, Venegas, published Oct. 29, 1986, incorporated herein by reference which refers to a modified bacterial serine proteolytic enzyme called "Protease A" therein.

The proteolytic enzyme stock solution herein generally has an activity of about 30 to 40 grams of active enzyme per liter of the enzyme stock solution. In the present liquid detergent compositions, the enzyme stock solution is preferably included in an amount sufficient to provide an activity of from about 0.6 to about 2.0, more preferably from about 0.7 to about 1.5, most preferably from about 0.8 to about 1.2, grams of active enzyme per liter of composition.

Water

Finally, the compositions herein contain from about 35% to about 55%, preferably from about 40% to about 50%, by weight of water.

Optional Ingredients

An enzyme stabilization system, preferably comprising calcium ion, boric acid, propylene glycol and/or short chain carboxylic acids, is preferably included in the liquid detergent compositions herein. The enzyme stabilization system comprises from about 0.5% to about 15% by weight of the composition.

The composition preferably contains from about 0.01 to about 50, preferably from about 0.1 to about 30, more preferably from about 1 to about 20, millimoles of calcium ion per liter. The level of calcium ion should be selected so that there is always some minimum level available for the enzyme, after allowing for complexation with builders, etc., in the composition. Any water-soluble calcium salt can be used as the source of calcium ion, including calcium chloride, calcium formate, and calcium acetate. A small amount of calcium ion, generally from about 0.05 to about 0.4 millimoles per liter, is often also present in the composition due to calcium in the enzyme slurry and formula water. From about 0.03% to about 0.6% of calcium formate is preferred.

Polyols containing carbon, hydrogen and oxygen atoms are also preferred enzyme stabilizers. They preferably contain from 2 to 6 carbon atoms and from 2 to 6 hydroxy groups. Examples include propylene glycol (especially 1,2 propanediol, which is preferred), ethylene glycol, glycerol, sorbitol, mannitol, and glucose. The polyol generally represents from about 0.5% to about 15%, preferably from about 1.5% to about 8%, by weight of the composition. Preferably, the weight ratio of polyol to any boric acid added is at least 1, more preferably at least about 1.3.

The compositions preferably also contain the water-soluble, short chain carboxylates described in U.S. Pat. No. 4,318,818, Letton et al., issued Mar. 9, 1982, incorporated herein by reference. The formates are preferred and can be used at levels of from about 0.05% to about 5%, preferably from about 0.2% to about 2%, most preferably from about 0.4% to about 1.5%, by weight of the composition. Sodium formate is preferred.

The compositions herein also optionally contain from about 0.25% to about 5%, most preferably from about 0.4% to about 1%, by weight of boric acid. The boric acid can be, but is preferably not, formed by a compound capable of forming boric acid in the composition. Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Other optional components for use in the liquid detergents herein include soil removal agents, soil release polymers, anti-redeposition agents, suds regulants, hydrotropes such as sodium cumene, sulfonate, opacifiers, antioxidants, bactericides, dyes, perfumes, and brighteners known in the art. Such optional components generally represent less than about 15%, preferably from about 0.5% to about 10%, more preferably from about 1% to about 10%, by weight of the composition.

The compositions herein optionally contain from about 0.1% to about 1%, preferably from about 0.2% to about 0.6%, by weight of chelating agents such as water-soluble salts of ethylenediamine tetramethylenephosphonic acid, diethylenetriamine pentamethylenephosphonic acid, ethylenediamine tetraacetic acid (preferred), or diethylenetriamine pentaacetic acid (most preferred) to enhance cleaning performance when pretreating fabrics.

The compositions of the present invention preferably have a pH, in a 10% by weight solution in water at 20° C., of from about 7.0 to about 10.0, more preferably from about 8.0 to about 9.5.

The following examples illustrate the compositions of the present invention. All parts, percentages and ratios used herein are by weight unless otherwise specified.

EXAMPLES

The following liquid laundry detergent compositions of the present invention are prepared by mixing the ingredients in the order listed. In the table, the following abbreviations are used.

$C_{45}E_{2.25}S$ is $C_{14-15}$ alkyl polyethoxylate (2.25) sulfonic acid, which is added as a paste containing 50% active, 12.25% 1,2-propanediol, 7% ethanol, 6% NaOH, and water.

$C_{12}LAS$ is $C_{12.3}$ (avg.) linear alkylbenzene sulfonic acid.

$C_{23}E_{6.5}T$ is $C_{12-13}$ alcohol polyethoxylate (6.5), topped to remove unexthoxylated and monoethoxylated alcohols.

FWA-1 is premix containing 4.5% brightener, 40% $C_{23}E_{6.5}T$, 15% MEA and water.

FWA-2 is premix containing 6.17% brightener, 24.69% $C_{23}E_{6.5}T$, 19.75% MEA and water.

MEA is monoethanolamine.

NaCS is sodium cumene sulfonate.

TEPA-$E_{15-18}$ is tetraethylene pentaimine ethoxylated with 15–18 moles (avg.) of ethylene oxide at each hydrogen site on each nitrogen.

Fatty Acid is $C_{12-14}$ fatty acid.

NaTS is sodium tartrate mono- and di-succinate (80:20 mix), which is added as a premix containing 37% active, 3% Na Formate, 2% citric acid, and water.

Na Formate is sodium formate.

Ca Formate is calcium formate.

Boric Acid is added as a premix containing 30% active, 14% MEA, and water.

Protease is a Protease B stock solution having an activity of 34 grams of active Protease B enzyme per liter of the stock solution, and containing 40% 1,2-propanediol, 8% Na Formate, and water.

| | Example 1 | | Example 2 | | Example 3 | |
|---|---|---|---|---|---|---|
| Ingredient | Wt. % Finished Product | Wt. % Stock Added | Wt. % Finished Product | Wt. % Stock Added | Wt. % Finished Product | Wt. % Stock Added |
| $C_{23}E_{6.5}T$ | 1.71 | XXX | 1.71 | 0.89 | 1.78 | 0.93 |
| FWA-1 | 0.10 | 2.22 | XXX | XXX | XXX | XXX |
| FWA-2 | 0.20 | 3.24 | 0.20 | 3.24 | 0.208 | 3.37 |
| MEA | 3.50 | 2.29 | 3.50 | 2.63 | 3.65 | 2.52 |
| (moles) | (0.057) | | (0.057) | | (0.060) | |
| $C_{45}E_{2.25}S$ | 12.00 | 24.00 | 12.00 | 24.00 | 12.50 | 25.00 |
| 1,2-Propanediol | 3.88 | XXX | 3.81 | XXX | 3.97 | XXX |
| Ethanol | 1.68 | XXX | 1.68 | XXX | 1.75 | XXX |
| NaCS (45%) | 2.90 | 6.44 | 2.90 | 6.44 | 3.02 | 6.71 |
| Start mild agitation | | | | | | |
| NaOH (50%) | 3.50 | 4.12 | 3.50 | 4.12 | 5.10 | 7.20 |
| NaTS | 3.40 | 9.19 | 3.40 | 9.19 | XXX | XXX |
| Na Formate | 0.46 | XXX | 0.45 | XXX | 0.18 | XXX |
| Add 33% of residual $H_2O$ | 6.21 | 6.21 | 6.66 | 6.66 | 6.17 | 6.17 |
| Start moderate agitation and cooling | | | | | | |
| $C_{12}$ LAS (96%) | 11.00 | 11.46 | 11.00 | 11.46 | 11.46 | 11.94 |
| Fatty Acid | 2.50 | 2.50 | 2.50 | 2.50 | 2.60 | 2.60 |
| Citric Acid (50%) | 3.80 | 7.23 | 3.80 | 7.23 | 6.04 | 12.08 |
| Ca Formate (10%) | 0.20 | 2.00 | 0.20 | 2.00 | 0.10 | 1.00 |
| Boric Acid | 0.50 | 1.67 | 0.50 | 1.67 | 1.00 | 3.33 |
| TEPA-$E_{15-18}$ (80%) | 1.50 | 1.88 | 1.38 | 1.73 | 1.44 | 1.80 |
| Suds Suppresor (50% in $C_{23}E_{6.5}T$) | 0.02 | 0.04 | 0.02 | 0.04 | 0.02 | 0.04 |
| Add 67% of residual $H_2O$ | 12.57 | 12.57 | 13.48 | 13.48 | 12.48 | 12.48 |
| Cool to 74° F. (23.3° C.) | | | | | | |
| Dye | 0.19 | 0.19 | 0.19 | 0.19 | 0.20 | 0.20 |
| Perfume | 0.40 | 0.40 | 0.35 | 0.35 | 0.36 | 0.36 |
| Protease | 2.35 | 2.35 | 2.18 | 2.18 | 2.27 | 2.27 |
| (Total Water) | (44.40) | | (44.92) | | (42.58) | |

The above compositions of the invention are clear, homogeneous and phase stable liquids that do not exhibit protease crystallization. Other compositions of the invention similar to Example 1 but containing 4% MEA and 3.16% NaOH; 5% MEA and 2.51% NaOH; 0% MEA, 8.55% triethanolamine (0.057 moles alkanolamine), and 5.48% NaOH; and 0% MEA, 12.21% triethanolamine, and 5.38% NaOH also are clear, homogeneous, phase stable liquids that do not exhibit protease crystallization.

What is claimed is:

1. A heavy-duty liquid detergent composition comprising, by weight:

(a) from about 20% to about 35% of an anionic synthetic surfactant;
(b) from about 7% to about 15% of a water-soluble carboxylate builder;
(c) from about 1.5% to about 5% of a proteolytic enzyme stock solution;
(d) from about 0.055 to about 0.25 moles per 100 grams of composition of monoethanolamine or triethanolamine, or mixtures thereof; and
(e) from about 35% to about 55% of water.

2. A heavy duty liquid detergent composition according to claim 1 comprising from about 22% to about 30% of an anionic synthetic surfactant selected from the group consisting of alkyl sulfates containing from about 10 to about 18 carbon atoms, alkyl ethoxy sulfates containing from about 10 to about 18 carbon atoms and an average of up to about 4 ethylene oxide units per mole of alkyl sulfate, linear alkylbenzene sulfonates containing from about 11 to about 13 carbon atoms, and mixtures thereof.

3. A heavy duty liquid detergent composition according to claim 2 further comprising from about 1% to about 10% by weight of an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (Hydrophilic-Lipophilic Balance) of from about 6 to about 14.

4. A heavy duty liquid detergent composition according to claim 3 comprising from about 1.5% to about 5% of an ethoxylated nonionic surfactant which is a condensation product of $C_{12}$–$C_{15}$ alcohol with from about 3 to about 8 moles of ethylene oxide per mole of alcohol.

5. A heavy duty liquid detergent composition according to claim 1 wherein said builder comprises from about 1% to about 5% by weight of a saturated fatty acid builder containing from about 12 to about 14 carbon atoms.

6. A heavy duty liquid detergent composition according to claim 1 wherein said builder comprises from about 2% to about 12% by weight of water-soluble polycarboxylate builder.

7. A heavy duty liquid detergent composition according to claim 6 wherein said builder comprises from 3% to about 8% by weight of citric acid.

8. A heavy duty liquid detergent composition according to claim 7 wherein said builder from about 1% to about 5% by weight of a saturated fatty acid builder containing from about 12 to about 14 carbon atoms.

9. A heavy duty liquid detergent composition according to claim 8 comprising from about 22% to about 30% of an anionic synthetic surfactant selected from the group consisting of alkyl sulfates containing from about 10 to about 18 carbon atoms, alkyl ethoxy sulfates containing from about 10 to about 18 carbon atoms and an average of up to about 4 ethylene oxide units per mole of alkyl sulfate, linear alkylbenzene sulfonates containing from about 11 to about 13 carbon atoms, and mixtures thereof.

10. A heavy duty liquid detergent composition according to claim 1 comprising from about 2% to about 3% by weight of proteolytic enzyme.

11. A heavy duty liquid detergent composition according to claim 10 wherein the proteolytic enzyme provides an activity of from about 0.7 to about 1.5 grams of active enzyme per liter of composition.

12. A heavy duty liquid detergent composition according to claim 11 wherein the proteolytic enzyme is Protease B.

13. A heavy duty liquid detergent composition according to claim 9 wherein the proteolytic enzyme is Protease B.

14. A heavy duty liquid detergent composition according to claim 13 wherein the proteolytic enzyme provides an activity of from about 0.7 to about 1.5 grams of active enzyme per liter of composition.

15. A heavy-duty liquid detergent composition comprising, by weight:
(a) from about 20% to about 35% of an anionic synthetic surfactant;
(b) from about 7% to about 15% of a water-soluble carboxylate builder;
(c) from about 1.5% to about 5% of a proteolytic enzyme stock solution;
(d) from about 0.055 to about 0.2 moles of monoethanolamine per 100 grams of composition; and
(e) from about 35% to about 55% of water.

16. A heavy duty liquid detergent composition according to claim 15 comprising from about 0.01 to about 50 millimoles of calcium ion per liter of composition.

17. A heavy duty liquid detergent composition according to claim 16 comprising from about 0.03% to about 0.6% by weight of sodium or calcium formate.

18. A heavy duty liquid detergent composition according to claim 17 further comprising from about 1.5% to about 8% by weight of propylene glycol.

* * * * *